United States Patent [19]

Tokura et al.

[11] 4,074,069

[45] Feb. 14, 1978

[54] METHOD AND APPARATUS FOR JUDGING VOICED AND UNVOICED CONDITIONS OF SPEECH SIGNAL

[75] Inventors: Yoichi Tokura, Kodaira; Shinichiro Hashimoto, Koganei, both of Japan

[73] Assignee: Nippon Telegraph & Telephone Public Corporation, Japan

[21] Appl. No.: 691,780

[22] Filed: June 1, 1976

[30] Foreign Application Priority Data

June 18, 1975 Japan ..... 50-73063
July 15, 1975 Japan ..... 50-86277

[51] Int. Cl.[2] ..... G10L 1/00
[52] U.S. Cl. ..... 179/1 SC
[58] Field of Search ..... 179/1 SC, 1 SA, 1 VC; 340/148

[56] References Cited

U.S. PATENT DOCUMENTS 3,662,115 5/1972 Saito ..... 179/1 SA
3,740,476 6/1973 Atal ..... 179/1 SC

OTHER PUBLICATIONS

W. Hess, "On-Line Digital Pitch Period Extractor," International Zurich Seminar, Mar., 1974, (IEEE Publ.).

W. McCray, "Pitch Period Detection," IBM Tech. Disclosure Bulletin, vol. 16, No. 4, Sept., 1973.

M. Sondhi, "New Methods of Pitch Extraction," IEEE Trans. Audio, vol. AU-16, No. 2, June 1968.

*Primary Examiner*—Kathleen Claffy
*Assistant Examiner*—E. S. Kemeny
*Attorney, Agent, or Firm*—Charles W. Helzer

[57] ABSTRACT

The voiced and unvoiced conditions of a speech signal are judged by combining a ratio (defined as the parcor coefficient $k_1$) $\phi(\tau s)/\phi(o)$ between the value $\phi(o)$ of the autocorrelation function of the speech signal at a zero delay time, and the value $\phi(\tau s)$ of the autocorrelation function at a delay time $\tau s$ of the sampling period with a parameter extracted from the speech signal by a correlation technique and representing the degree of periodicity ($P_m$) of the speech signal. By comparing the result of the combination against a predetermined threshold it can be determined whether the speech signal is in a voiced condition or in an unvoiced condition.

24 Claims, 7 Drawing Figures

METHOD AND APPARATUS FOR JUDGING VOICED AND UNVOICED CONDITIONS OF SPEECH SIGNAL

BACKGROUND OF THE INVENTION

This invention relates to a method of judging voiced and unvoiced conditions of a speech signal utilized in a speech analysis system, more particularly to a method of judging voiced and unvoiced conditions applicable to a speech analysis system utilizing a partial autocorrelation (PARCOR) coefficient, for example. Such speech analysis system utilizing the partial autocorrelation coefficient is constructed to analize and extract the fundamental feature of a speech signal necessary to transmit speech information by using a specific correlation between adjacent samples of a speech waveform, and is described in the specification of Japanese Pat. No. 754,418 of the title "Speech Analysis and Synthesis System", and in U.S. Pat. No. 3,662,115 — issued May 9, 1972 to Shuzo Saito, et al. for "Audio Response Apparatus Using Partial Autocorrelation Techniques", assigned to Nippon Telegraph and Telephone Corporation, Tokyo, Japan, for example.

In a prior art voiced/unvoiced detector the voiced and unvoiced conditions of a speech signal are determined dependent upon whether the peak value $\phi m = \phi(T)$ of the autocorrelation coefficient $\phi(T)$ of a speech signal exceeds a certain threshold value or not wherein the delay time $\tau = T$ corresponding to the peak value is taken as the pitch period of the speech signal. Such method is described in a paper of M. M. Sondhi of the title "New Methods of Pitch Extraction", I.E.E.E., Vol. Au-16, No. 2, June 1968, pages 262 - 265.

However, if such method utilizing only the periodicity of the speech signal is used for the voiced/unvoiced detector of the speech analysis and synthesis system, there may be a fear of misjudging the voiced and unvoiced of a speech signal, with the result that the voiced portion synthesized from misjudged parameters resulting from the analysis would be excited by a noise acting as an unvoiced excitation source, or the unvoiced portion would be excited by a pulse train acting as a voiced excitation source, thus making it difficult to reproduce a synthetic speech of high quality.

Explaining the prior art method with reference to FIG. 1, the prior art method does not consider the coexistence of the voiced excitation source V, and the unvoiced excitation source UV as in a voiced/unvoiced switching function $V_1(x)$.

On the contrary, in speech analysis systems utilizing the partial autocorrelation coefficient, the delay time $\tau = T$ corresponding to the peak value W(T) of the autocorrelation coefficient of the residual signal is used as the pitch period and the normalized value $\rho m = W(T)/W(o)$ of the peak value is used as a parameter for judging the voiced and unvoiced conditions of a speech signal, and the coexistence of the voiced excitation V and the unvoiced excitation UV is considered. According to such method the ratio of the voiced excitation V to the unvoiced excitation under the condition of coexistence thereof is determined by such switching functions as $V_2(x)$ and $V_3(x)$ as shown in FIG. 1 which utilize the peak valve $\rho m$ as a variable. This method is also disclosed in said Japanese Pat. No. 754,418.

The method is excellent in that it can compensate for imperfect judgement of the voiced excitation and the unvoiced excitation caused by the variance of the peak volume $\rho m$ but the compensation is not yet perfect and furthermore the voiced/unvoiced information becomes too large. Hence this method has certain shortcomings.

SUMMARY OF THE INVENTION

Accordingly, it is an object of this invention to provide an improved method of judging the voiced and unvoiced conditions of a speech signal, which is capable of judging at high accuracies the voiced and unvoiced conditions of a speech signal and is useful for a speech analysis system.

Another object of this invention is to provide an improved method of judging the voiced and unvoiced conditions of a speech signal at high accuracies with an apparatus having a a minimum number of the component parts and which is simple in construction and operation.

According to this invention there is provided a method and improved apparatus for judging voiced and unvoiced conditions for analyzing a speech, and which performs the steps of determining a ratio $\phi(\tau s)/\phi(o)$ between the value $\phi(o)$ of the autocorrelation function of a speech signal at a zero delay time and the value $\phi(\tau s)$ of the autocorrelation function at a delay time $\tau s$ of a sampling period, combining the ratio with a parameter extracted from the speech signal by correlation technique and representing the degree of periodicity, and judging the voiced and unvoiced conditions of the speech signal in accordance with the result of combination.

According to another embodiment of this invention, there is provided a method and apparatus for judging voiced and unvoiced conditions of a speech signal, which performs the steps of determining a ratio $\phi(\tau s)/\phi(o)$ between the value $\phi(o)$ of the correlation function of a speech signal at a zero delay time, and the value $\phi(\tau s)$ of the autocorrelation function at a delay time $\tau s$ of a sampling period, multiplying the ratio with a constant $a$ to obtain a product, adding the product to the normalized value $\phi(T)/\phi(o)$ of the autocorrelation function at a delay time T corresponding to the pitch period of the speech signal to obtain a sum, and comparing the sum with a predetermined threshold value thereby judging that the speech signal is in an unvoiced condition when the sum is smaller than the threshold value and that the speech signal is in a voiced condition if the sum is larger than the threshold value.

According to still another embodiment of this invention there is provided a method and apparatus for judging voiced and unvoiced conditions of a speech signal, which performs the steps of determining a ratio $\phi(\tau s)/\phi(o)$ between the value $\phi(o)$ of the autocorrelation function of a speech signal at a zero delay time and the value $\phi(\tau s)$ of the autocorrelation function of the sampling period at a delay time $\tau s$ of a sampling period, multiplying the ratio with the normalized value of the auto-correlation function at a delay time T corresponding to the pitch period of the speech signal to obtain a product, and comparing the product with a predetermined threshold value thereby judging that the speech signal is in an unvoiced condition when the product is smaller than the threshold value and that the speech signal is in a voiced condition if the product is larger than the threshold value case.

According to yet another embodiment of this invention, there is provided a method and apparatus for judging voiced and unvoiced conditions of a speech signal, which performs the steps of determining a ratio $\phi(\tau s)/\phi(o)$ between the value $\phi(o)$ of the autocorrelation function of a speech signal at a zero delay time and the value $\phi(\tau s)$ of the autocorrelation function at a delay time $\tau s$ of a sampling period, multiplying the ratio with a constant $b$ to obtain a product, adding the product to the normalized value $\rho m = W(T)/W(o)$ of the value $W(T)$ at a delay time $T$ of the autocorrelation function of a residual signal obtainable by the linear predictive analysis of the speech signal to obtain a sum, and comparing the sum with a predetermined threshold value thereby judging that the speech signal is in an unvoiced condition when the sum is smaller than the threshold value and that the speech signal is in a voiced condition if the sum is larger than the threshold value.

According to a further embodiment and apparatus for this invention, there is provided a method of judging voiced and unvoiced condition of a speech signal, which performs the steps of determining a ratio $\phi(\tau s)/\phi(o)$ between the value $\phi(o)$ of the autocorrelation function of a speech signal at a zero delay time and the value $\phi(\tau s)$ of the autocorrelation function at a delay time $\tau s$ of a sampling period, multiplying the ratio with the normalized value $\rho m = W(T)/W(o)$ at a delay time T of the autocorrelation function of a residual signal obtainable by a linear predictive analysis of the speech signal to obtain a product, and comparing the product with a predetermined threshold value thereby judging that the speech signal is in an unvoiced condition when the product is smaller than the threshold value and that the speech signal is in a voiced condition if the product is larger than the threshold value.

According to a still further embodiment of this invention there is provided a method and apparatus for judging voiced and unvoiced conditions of a speech signal, which performs the steps of determining a ratio $\phi(\tau s)/\phi(o)$ between the value $\phi(o)$ of the autocorrelation function of a speech signal at a zero delay time, and the value $\phi(\tau s)$ of the autocorrelation function at a delay time $\tau s$ of a sampling period, multiplying the ratio with a constant $a$ to obtain a product, subtracting the product from the value D(T) at a delay time T of the average magnitude difference function of a residual signal obtainable by a linear predictive analysis of the speech signal to obtain a difference, and comparing the difference with a predetermined threshold value thereby judging that the speech signal is in an unvoiced condition when the difference is larger than the threshold value and that the speech signal is in a voiced condition if the difference is smaller than the threshold value.

DESCRIPTION OF THE PREFERRED EMBODIMENTS

In the following description, the terms employed in the various expressions appearing in the description are defined as set forth in the following Glossary of Terms:

GLOSSARY OF TERMS $W_{(\tau)}$ = Autocorrelation function of the residual signal obtained by a linear predictive analysis $W_{(T)}$ = Peak value of autocorrelation coefficient of residual signal $W_{(O)}$ = Peak value of autocorrelation coefficient of residual signal at zero delayed time of speech signal.

$\rho_M$ = W(T)/W(O); Maximum normalized value of Autocorrelation of Residuals representing the degree of the periodicity of a speech signal. May also be determined by $\phi_{(T)}/\phi_{(O)}$.

$\tau s$ = Sampling period of speech signal $\phi_{(\tau)}$ = Autocorrelation function of speech signal $\phi_{(\tau s)}$ = Value of autocorrelation function $\phi(\tau)$at a delayed time $\tau s$ of the sampling period $\phi_{(T)}$ = Peak value of autocorrelation coefficient of speech signal $\phi_{(O)}$ = Value of the autocorrelation function $\phi(\tau)$ at zero delayed time of speech signal $k_1 = \phi(\tau s)/\phi(o)$ (Parcor Coefficient)

$a$ = Constant representing the slope of a straight line between voiced (V) regions and unvoiced regions (UV)*

$t$ = Threshold value determined by maximum value of the autocorrelation coefficient of the residual or the speech signal when the PARCOR coefficient $k_1 = o$ $b$ = Constant representing the slope of a straight line between voiced regions and unvoiced regions (but its absolute value is different from "$a$")*

$T$ = Delay time corresponding to the pitch period of speech signal ($\tau$)

$D(\tau)$ = Average magnitude difference function of the residual signal

* "$a$" is used when the periodicity is described by autocorrelation function of speech signal. On the other hand, "$b$" is used when the periodicity is described by autocorrelation function of residual signal.

Figure 1:
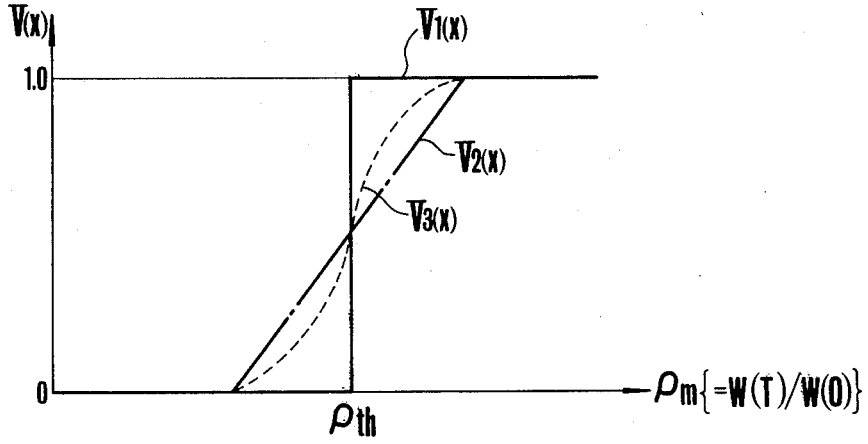
FIG. 1 is a graph showing one example of a voiced-/unvoiced switching function Vx useful to explain a prior art voiced/unvoiced detector.
Figure 2:
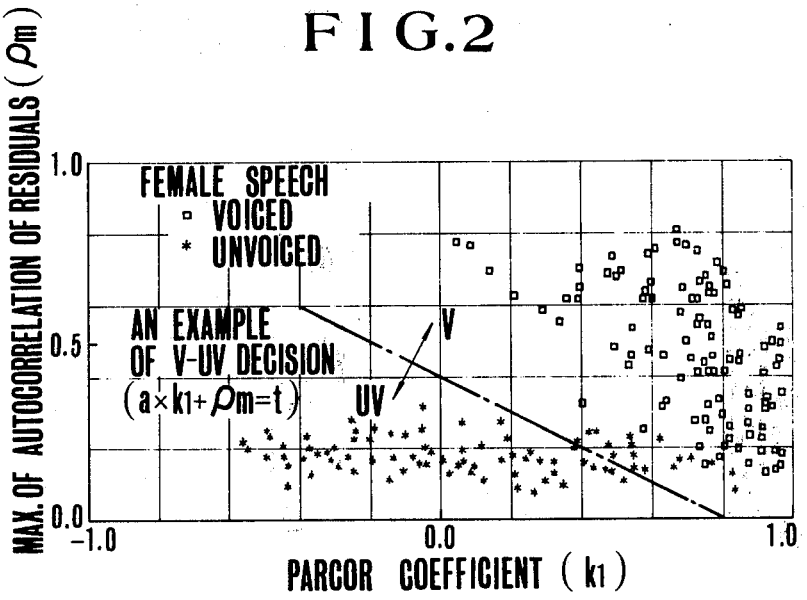
FIG. 2 is a $\rho$m-$k_1$ characteristic curve showing the result of the voiced/unvoiced decision made by combining the partial autocorrelation coefficient $k_1$ and the maximum value $\rho m$ of the autocorrelation coefficient of the residual.

We have analyzed a speech signal by using a time window of 20 ms (milli seconds) and at a rate of a frame period of 10 ms and obtained partial autocorrelation (PARCOR) coefficients. FIG. 2 shows a maximum value of the autocorrelation coefficient of the residuals $\rho m$ plotted against the first order PARCOR coefficient characteristic $k_1$ thus obtained. The characteristic $k_1$ was obtained by performing a PARCOR analysis of the utterance for three seconds of a female speaker. In FIG. 2, squares and asterisks show the voiced and unvoiced conditions respectively in each frame obtained manually by reading the waveform of the original speech.

According to the prior art method, if the speech signal was judged as the voiced condition by noting that $\rho m$ exceeds as predetermined fixed threshold value, it will be understood from FIG. 2 that the voiced region shown in the right lower portion of FIG. 2 would be misjudged as the unvoiced region. By decreasing the threshold value, it will be possible to judge that the right lower portion represents the voiced region. However, under the lowered threshold value conditions many unvoiced regions will be misjudged as the voiced regions. In other words, there is a limit for the prior art method in which the voiced and unvoiced conditions are judged by using only $\rho m$ representing the degree of the periodicity as the parameter.

The following two points should be considered regarding the relationship between the judgment of the voiced/unvoiced conditions and the quality of the synthetic speech.

1. Misjudgment of the voiced condition for the unvoiced condition deteriorates the naturalness of the synthetic speech.

2. Misjudgment of the unvoiced condition for the voiced condition degrades the intelligibility of the voiceless sounds.

The former misjudgment has much greater influence upon the overall quality of the synthetic speech than the latter. Accordingly, in order to properly set the criterion for the judgment, greater care should be taken primarily not to misjudge the voiced condition for the unvoiced condition, than is necessary to prevent the misjudgement of the unvoiced condition for the voiced condition in a range in which said condition is fulfilled.

From the considerations described above it will be noted that above described problems can be solved by judging that the voiced condition exists when $\rho m + a \times k_1 \leqq t$ whereas the unvoiced conditions exists when $\rho m + a \times k_1 < t$ where $a$ and $t$ are constants. Thus, $a$ represents the slope of a straight line between the voiced and unvoiced regions and $t$ shows the maximum value of the autocorrelation coefficient of the residual $\rho m$ when the PARCOR coefficient $k_1 = 0$. From FIG. 2 it can be determined that $a = 0.5$ and $t = 0.4$, for example.

More particularly, $\rho m$ is a parameter representing the degree of periodicity of the speech signal, whereas the PARCOR coefficient $k_1$ ($\equiv k_1 \equiv < 1$) combined with $\rho m$ has a value of approximately $-1$ for a speech signal having a component of high frequency near 4 KHz where $k_1$ is equal to the autocorrelation coefficient of a delay time $\tau s$ of a sampling period and where the sampling frequency is equal to 8 KHz. However, the value of the PARCOR coefficient $k_1$ approaches to $+1$ for a speech signal containing a low frequency component. Accordingly, the value of $k_1$ is large for a voiced condition represented by a vowel, whereas small for an unvoiced condition represented by a voiceless fricative. In other words, $k_1$ represents a frequency construction, for the parameter $\rho m$ representing the periodicity. To extract the periodicity, as it is necessary to process a unit length of about 30 ms of the speech signal in accordance with the characteristic of the periodicity, the temporal resolution of $\rho m$ is small. On the contrary, it is possible to increase the temporal resolution for extracting $k_1$ whereby it is possible to follow a voiced/unvoiced transition having a high rate of change with time.

Further, since $k_1$ represents the PARCOR coefficient it is not necessary to particularly determine this parameter when this invention is applied to the speech analysis system utilizing the PARCOR.

As can be understood from the foregoing analysis, the invention contemplates the judgment of whether the speech signal is in a voiced or unvoiced condition by combining a parameter, for example $\rho m$ that represents the degree of periodicity of a speech signal extracted by a correlation processing of the speech signal and a normalized value $\phi(\tau s)$ which is equal to the PARCOR coefficient $k_1$, where a delay time $\tau s$ is a sampling period of the speech signal.

Figure 3:
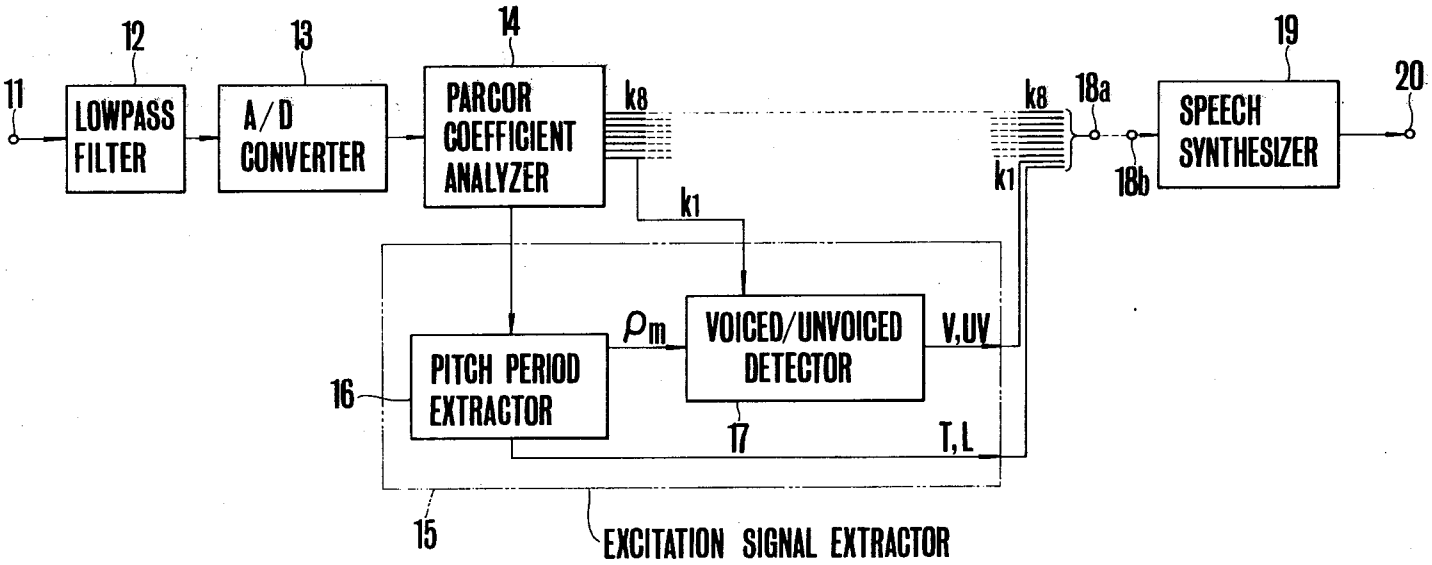
FIG. 3 is a block diagram showing the basic construction of a speech analysis and synthesis device incorporated with the voiced/unvoiced detector embodying the invention which utilizes the result of judgment shown in FIG. 2.

The invention will now be described in terms of certain embodiments thereof. FIG. 3 is a block diagram of a speech analysis and synthesis system incorporated with one embodiment of the voiced/unvoiced detector of this invention utilizing the result of judgment shown in FIG. 2. In FIG. 3, a speech signal is applied to a lowpass filter 12 through an input terminal for eliminating frequency components higher than 3.4 KHz, for example. The output from the lowpass filter 12 is coupled to an analogue-digital converter 13 which samples the output at a sampling frequency of 8 KHz and then subjects it to an amplitude quantization thereby producing a digital signal including 12 bits. The output from the analogue-digital converter 13 is coupled to a PARCOR (partial correlation) coefficient analyzer 14 which analyzes the frequency spectral envelope of the speech signal for determining eight PARCOR coefficients $k_1$ through $k_8$, for example.

Figure 4:
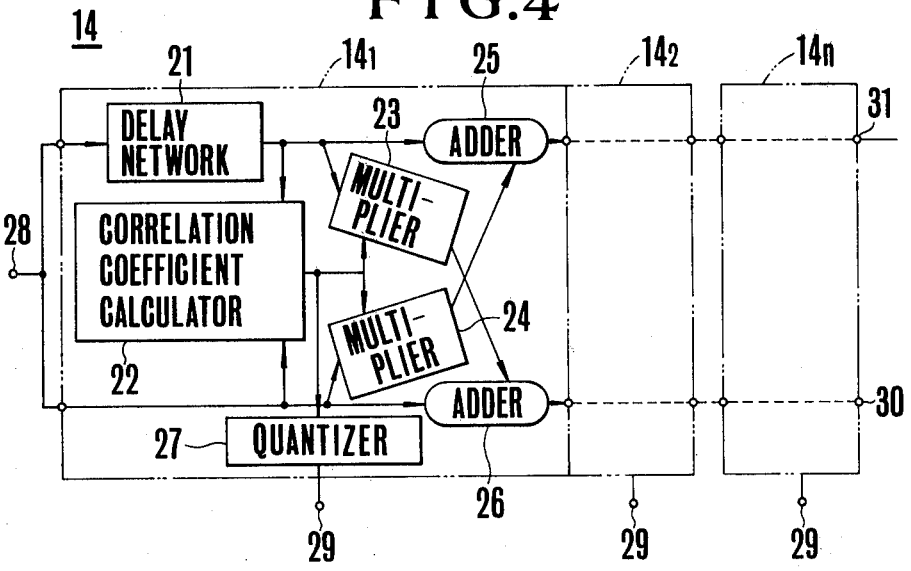
FIG. 4 is a block diagram showing the detail of the PARCOR (partial autocorrelation) analyzer utilized in the circuit shown in FIG. 3.

One example of the PARCOR coefficient analyzer 14 is shown in FIG. 4 and comprises $n$ stage partial autocorrelators $\mathbf{14}_1$ through $\mathbf{14}n$ which are connected in cascade. Since all partial autocorrelators have the same construction one partial autocorrelator 14, will be described in detail. The partial autocorrelator 14, comprises a delay network 21 for delaying the speech signal by one sampling period $\tau s$, a correlation coefficient calculator 22, multipliers 23 and 24, adders 25 and 26, and a quantizer 27. The partial autocorrelator stage $\mathbf{14}_1$ is provided with an input terminal 28 for receiving a speech signal and an output terminal 29 for producing the output for quantizer 27 and the quantized PARCOR coefficient of this stage, that is the first order PARCOR coefficient $k_1$. One output terminal 30 of the last stage 14n is idle, whereas the other output terminal 31 is used to send a residual signal to the autocorrelator of an excitation signal extractor 15 to be described later. The detail of the operation of the PARCOR coefficient analyzer 14 is described in U.S. Pat. No. 3,662,115 issued on May 9, 1972 and having a title "Audio Response Apparatus Using Partial Autocorrelation Techniques."

Turning back to FIG. 3 there is provided an excitation signal extractor 15 connected to receive the first order PARCOR coefficient $k_1$ among the outputs of the PARCOR coefficient analyzer 14, and the residual signal from the last state $\mathbf{14}_n$ of the PARCOR coefficient analizer 14. The excitation signal extractor 15 comprises a pitch period detector 16 and a voiced/unvoiced detector 17 embodying the invention. The excitation signal extractor 15 determines the autocorrelation function $W(\tau)$ of the residual signal from one of the outputs of the PARCOR coefficient analyzer provided through output terminal 31, and selects the peak value $\rho m$ of the autocorrelation function $W(\tau)$ by the maximum value selector thus determining a delay time T corresponding to the selected peak value $\rho m$ as the pitch period of the speech signal.

Figure 5:
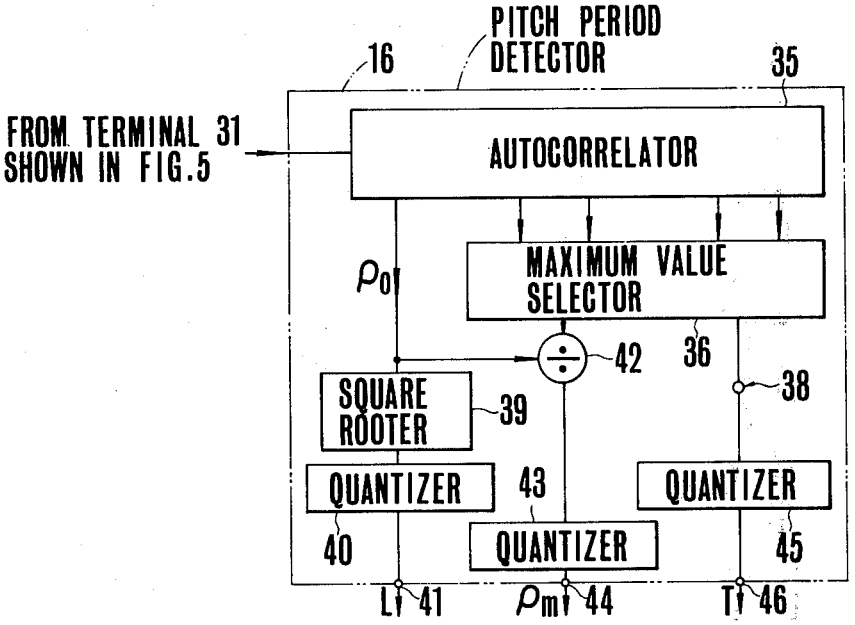
FIG. 5 is a block diagram showing the detail of a pitch period detector utilized in the circuit shown in FIG. 3.

The detail of the pitch detector 16 is shown in FIG. 5 and comprises an autocorrelator 35 which determines the autocorrelation function $W(\tau)$ of the residual signal. Among a plurality of outputs from the autocorrelator 35, output $\rho o = W(o)$ is used to extract a component having an amplitude L and normalize $\rho m$, in a manner to be described later. The pitch period detector 16 further comprises a maximum value selector 36 for extracting a maximum value W(T) in a range of $j \times \tau s \leqq \tau \leqq k \times \tau s$ among various values of $W(\rho)$, where $\rho s$ represents the sampling period of the speech signal, and j and k are integers selected such that the pitch period will be included in the range described above. Where the sampling frequency is equal to 8 KHz, it is selected that $j = 16$ and $k = 120$. The delay time T corresponding to the delay time which provides the maximum value W(T) in this range is determined as the pitch period (expressed by an integer multiple of $\tau s$) and applied to a terminal 38. A value at a zero delay time $\rho o = W(o)$ representing the power of the excitation signal is applied to a square rooter 39, where $L = \sqrt{\rho m}$ is calculated, and the output from the square rooter is applied to an output terminal 41 via a quantizer 40.

The peak value extracted by the maximum value selector 36 is divided by signal $\rho o$ at a divider 42 so as to be normalized and the normalized value is supplied to terminal 44 as a signal $\rho m$ via a quantizer 43. The delay time T corresponding to the delay time when the maximum value selector 36 selects a peak value is applied to terminal 46 via another quantizer 45.

Figure 6:
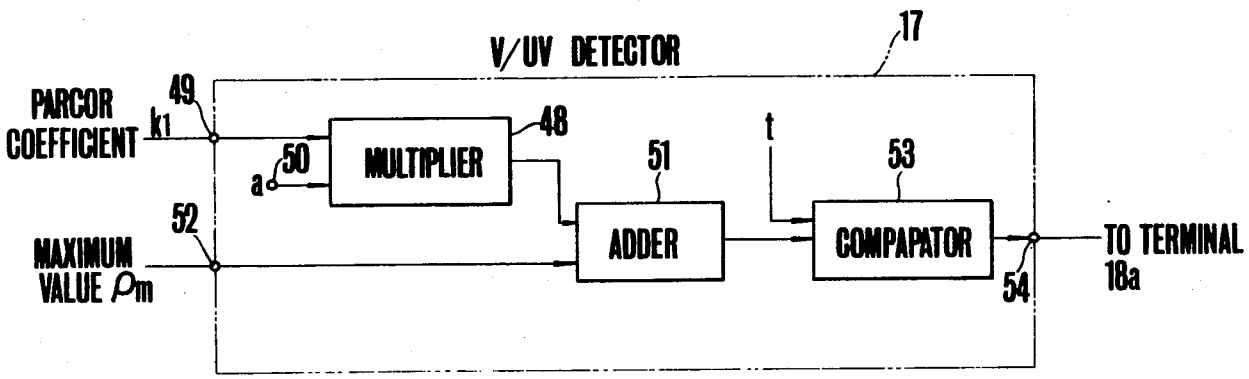
FIG. 6 is a block diagram showing the detail of a voiced/unvoiced detector utilized in the circuit shown in FIG. 3.

FIG. 6 shows one example of the voiced/unvoiced detector 17, which comprises a multiplier 48 - which computes a product $a \times k_1$ of a PARCOR coefficient supplied from PARCOR coefficient analyzer $\mathbf{14}_1$ via an input terminal 49 and a constant $a$ described above in connection with FIG. 2, an adder 51 which adds the normalized peak value $\rho m$ of the autocorrelation function of the residuals supplied from the pitch period detector 16 via terminal 52 to the output $(a \times k_1)$ of the multiplier thus producing a sum $(\rho m + a \times k_1)$, and a comparator 53 which compares this sum with a threshold value $t$ (a definite value). When $t > (\rho m + a \times k_1)$ the comparator 53 produces a "0" (low level) output whereas when $t \leqq (\rho m + a \times k_1)$ the comparator produces a "1" (high level) output which are applied to terminal 18*a* (See FIG. 3) via an output terminal 54. Thus, when the output from comparator 53 is "0" the speech signal is judged as an unvoiced condition whereas when the output is "1" the speech signal is judged as a voiced condition.

In FIG. 3, the PARCOR coefficients $k_1 - k_8$ extracted or analyzed by PARCOR coefficient analyzer 14 and excitation signals T, V, UV and L analyzed by excitation signal extractor 15 are applied to a common output terminal 18*a*. Where a digital transmission system is desired, a suitable digital code converter and a digital transmitter, not shown, are connected to the output terminal 18*a*. Where an audio response apparatus is desired, a suitable memory device is connected to terminal 18*a*. Signals derived out from terminal 18*a* through the apparatus just described are applied to a terminal 18*b* to which is connected a speech synthesizer 19 which functions to reproduce a speech signal in accordance with extracted parameter signals applied to terminal 18*b* from such apparatus as the digital transmitter and the memory device. The speech synthesizer may be any one of well known synthesizers, for example the one described in U.S. Pat. No. 3,662,115. The output from the speech synthesizer 19 is supplied to an output terminal 20.

The circuit shown in FIG. 3 operates as follows: From the speech signal applied to input terminal 11, high frequency components higher than 3.4 KHz, for example, are eliminated by the lowpass filter 12, and the output thereof is subjected to an amplitude quantizing processing of 12 bits at a sampling frequency of 8 KHz, for example, and then converted into a digital code by the analogue-digital converter 13. The output from the analogue-digital converter 13 is applied to the PARCOR coefficient analyzer or extractor 14 for extracting the frequency spectral envelope of the speech thereby determining eight PARCOR coefficients $k_1$ through $k_8$, for example. Among these outputs, the first order PARCOR coefficient $k_1$ and the residual signal are sent to the excitation signal extractor 15. As has been pointed out hereinabove, the first order PARCOR coefficient $k_1$ is equal to $\phi(\rho s)/\phi(o)$. In the excitation signal extractor 15, the voiced/unvoiced detector 17 computes the sum $(\rho m + ak_1)$ of the peak value $\rho m$ extracted by the pitch period extractor 16 and the primary PARCOR coefficient $k_1$. When the sum $(\rho m + ak_1)$ is larger than the threshold value $t$ the voiced/unvoiced detector judges that the condition is voiced, whereas when the sum is smaller than the threshold value $t$ an unvoiced condition is judged, and the outputs of respective conditions are applied to the output terminal 18*a*. Then the outputs are sent to terminal 18*b* through a digital transmitter or a memory device, not shown, and thence to the speech synthesizer 19 for reproducing a synthetic speech which is sent to output terminal 20.

The invention has various advantages enumerated as follows.

1. Since voiced and unvoiced conditions are judged in accordance with the ratio among a parameter $\rho m$ representing the degree of the periodicity of a speech signal, the value $\phi(o)$ of the autocorrelation function at a zero delayed time of the speech signal, and the value $\phi(\tau s)$ of the autocorrelation function at a delayed time $\tau s$ of the sampling period, it is possible to judge the voiced and unvoiced conditions (V and UV) at high accuracies.

2. Consequently it is possible to reproduce a synthetic speech of high quality.

3. Notwithstanding the fact that the voiced and unvoiced conditions can be judged by an extremely simple method of merely combining a small amount of component parts to prior art, it is possible to process them at high accuracies.

4. Since it is possible to judge the voiced and unvoiced conditions (V and UV) at high accuracies, coexistence of both voiced and unvoiced conditions as the excitation signals is not necessary as in the prior art apparatus.

To make more clear the advantages of this invention a paired comparison test was made for synthetic speeches synthesized by both the prior art method and the method of this invention and obtained preference scores as shown in the following table.

Table

| | Synthetic Sentence $S_1$ | Synthetic Sentence $S_2$ |
|---|---|---|
| Prior art | 20.8% | 57.8% |
| This invention | 41.2% | 80.2% |

To obtain these results, a synthetic sentence having a total bit rate of 9.6 k.bits/sec was used as the synthetic sentence $S_1$ and a synthetic sentence having a total bit rate of 27 k.bits/sec was used as the synthetic sentence $S_2$. These synthetic sentences were uttered by three female speakers respectively for 3.5 seconds. 10 male listeners were selected and the listening was repeated 10 times for each comparison pair. As can be noted from this table, the quality of the synthetic sentence reproduced from the excitation signals V and UV detected by the novel voiced/unvoiced detector of this invention is much higher than that of the synthetic sentence reproduced by the prior art detector.

In this embodiment when constant $a$ is set to 0.5, for example, it is possible to substitute a 1-bit shift register for the multiplier 48 shown in FIG. 6, thus simplifying the circuit.

It is also possible to form a combination $$(\phi(\tau s)/\phi(o)) \times \rho m$$

by using a normalized value $\rho m = W(T)/W(o)$ of the autocorrelation function of the residual at a delay time $T$ corresponding to the pitch period of the speech signal and to use this combination for judging that the speech signal is unvoiced when the value of the combination is smaller than a prescribed threshold value and that the speech signal is unvoiced in other cases. In this case, multiplier 48 and adder 51 are replaced by one multiplier such as 48 shown in FIG. 6 and the two signals $k_1$ and $\rho_m$ supplied thereto for multiplication and comparison of the product to the threshold signal.

Instead of using the autocorrelation function $W(\tau)$ of the residual, it is also possible to use the autocorrelation function of the speech waveform as $\rho m = \phi(T)/\phi(o)$ and to detect the voiced and unvoiced conditions according to the same procedure as above described.

Figure 7:
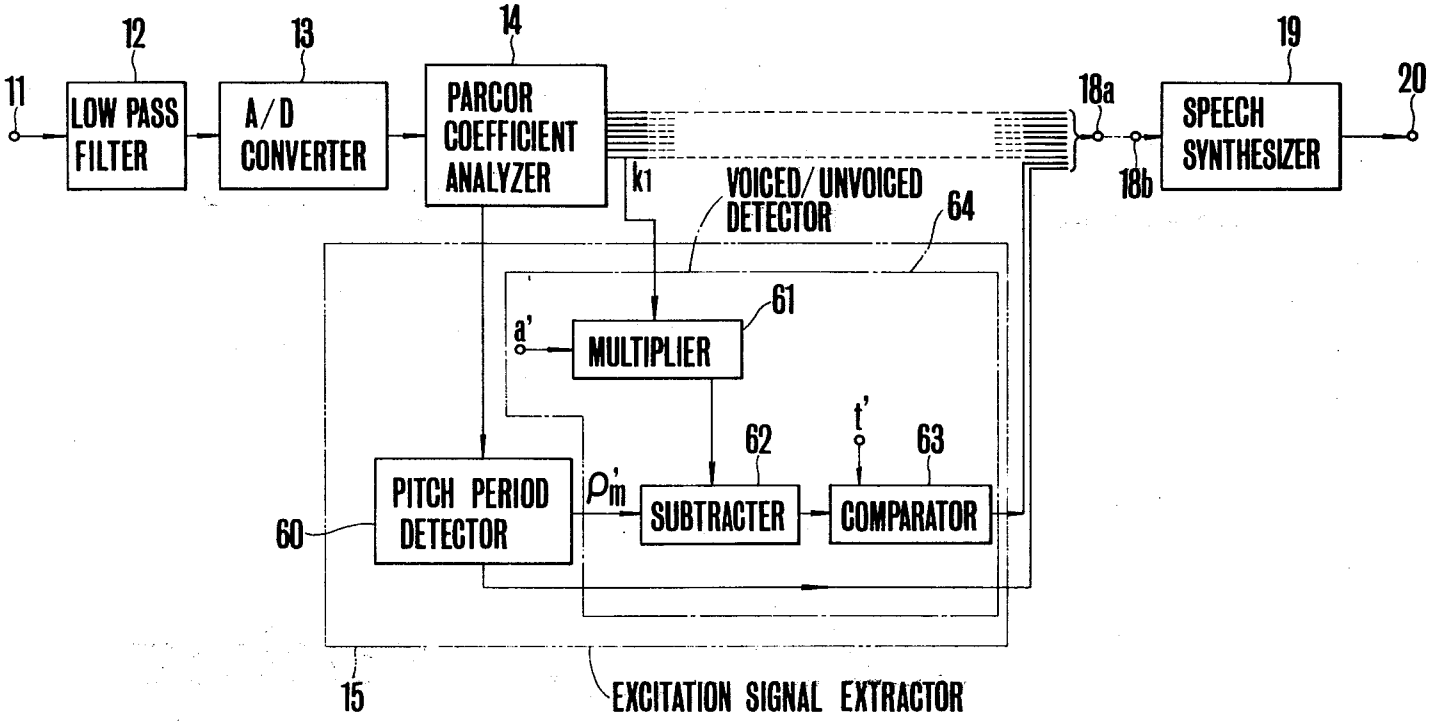
FIG. 7 is a block diagram showing a speech analysis and synthesis system utilizing a modified voiced/unvoiced detector of this invention.

FIG. 7 is a block diagram showing a speech analysis and synthesis apparatus utilizing a modified voiced/unvoiced detector of this invention, in which elements corresponding to those shown in FIG. 3 are designated by the same reference numerals. In FIG. 7, a pitch period detector 60 is used as one element of the excitation signal extractor 15 and is connected to receive a residual signal, one of a plurality of outputs of PARCOR coefficient analyzer 14. The pitch period detector 60 determines the average magnitude difference function (AMDF)$D(\tau)$ of the residual signal and selects the dip value of $D(\tau)$ by a minimum value selector, not shown, so as to use a delay time T corresponding thereto as the pitch period. The pitch period detector 60 produces an amplitude component L of the excitation source, and the dip value $\rho' m = D(T)$ of $D(\tau)$.

The method of using $D(\tau)$ instead of the autocorrelation function $\phi(\tau)$ is well known. For example, it is described in a paper of M. J. Ross et al. of a title "Average Magnitude Difference Function Pitch Extractor," I.E.E.E., Assp 22, No. 5, Oct. 1974. In the foregoing description $D(\tau)$ represents the average magnitude difference function of the delay time $\tau$ and expressed by an equation $$D(\tau) = \frac{1}{l} \cdot \sum_{i=1}^{l} (S_i - S_{i-\tau})$$

where $S_i$ represents $l$ sampled values of the speech signal, and $i = 1, 2 \ldots l$. There is also provided a multiplier 61 which multiplies constant $a'$ with the PARCOR coefficient $k_1$, that is the ratio of the value $\phi(o)$ of the autocorrelation function at the zero delay time of the speech signal to the autocorrelation function $\phi(\tau s)$ at a delay time $\tau s$ of the sampling period. As a result, the multiplier 61 produces an output $a' \times k_1 = a' \times \phi(\tau s)/\phi(o)$. The difference between the outputs from the multiplier 61 and the pitch period detector 60 is calculated by a subtractor 62, the output $(a' \times k_1 - \rho' m)$ thereof being applied to one input of a comparator 63. A threshold value $t'$ is applied to the other input of the comparator 63. Thus, the multiplier 61, substracter 62 and comparator 63 constitute a voiced/unvoiced detector 64.

The circuit shown in FIG. 7 operates as follows. Among a number of outputs from the PARCOR coefficient analyzer 14 the residual signal is applied to the excitation signal extractor 15. The pitch period detector 60 thereof determines the average magnitude difference function $D(\tau)$ of the residual signal and the dip value $\rho' m = D(T)$ of the function $D(\tau)$ is selected by the minimum value selection circuit.

In the voiced/unvoiced detector 64, multiplier 61 provides the product of the PARCOR coefficient $k_1 = \phi(\tau s)/\phi(o)$ from the PARCOR coefficient analyzer 14 and constant $a'$, and the output from the multiplier 64 is sent to subtractor 62 where the difference between said product and the output $\rho m$ from the pitch period extractor 60, that is $a' \times k_1 - \rho' m$ is determined. The output from the subtractor 62 is compared with threshold value $t$ by comparator 63. When $a' \times k_1 - \rho' m$ is larger than $t'$, a voiced condition is judged, whereas when $a' \times k_1 - \rho' m$ is smaller than $t'$, an unvoiced condition is judged. Thereafter, the same processing as in FIG. 3 is performed.

Although, in the foregoing embodiments, $\phi(\tau s)/\phi(o)$ was used as one of the parameter for detecting voiced and unvoiced conditions, it is not necessary to exactly match the delay time $\tau s$ with the sampling period $\tau(s)$, and a small variation in $\tau s$ does not affect the operation of this invention. By experiment we have confirmed that so long as $\tau s$ satisfies a relation $0 < \tau s < 1$ ms, it is possible to judge the voiced and unvoiced conditions at a sufficiently high accuracy.

Further, although the invention has been described as applied to the detection of an excitation signal for a speech analysis system utilizing the partial autocorrelation coefficient, it is also applicable to, a terminal analogue type speech analysis system utilizing a series of resonance circuits corresponding to the speech formant, a maximum likehood method for determining the frequency spectral envelope and a channel vocoder, wherein normalized $\phi(\tau s)$, $\phi(T)$ or like correlation functions which are derived out as a result of extracting feature parameters of the frequency spectral envelope or pitch period are used. Then the object of this invention can be attained by merely selecting proper values for $a$ and $t$ in accordance with the variation of the value of the correlation function that is used in the respective speech analysis system.

What is claimed is:

1. A method of judging voiced and unvoiced conditions of a speech signal, comprising the steps of determining a ratio $\phi(\tau s)/\phi(o)$ between the value $\phi(o)$ of the autocorrelation function of a speech signal at a zero delay time, and the value $\phi(\tau s)$ of the autocorrelation function at a delay time $\tau s$ of a sampling period, and combining said ratio with a parameter extracted from the speech signal by correlation technique and representing the degree of the periodicity of the speech signal thereby judging that the speech signal is in a voiced condition or an unvoiced condition.

2. The method according to claim 1 wherein said parameter is a normalized value $\phi(T)/\phi(o)$ of the autocorrelation function at a delay time T corresponding to the pitch period of the speech signal.

3. The method according to claim 1 wherein said parameter is the normalized value W(T)/W(o) at a delay time T corresponding to the pitch period of the autocorrelation function of the residual signal obtainable by a linear predictive analysis of the speech signal.

4. The method according to claim 1 wherein said parameter is the value of the average magnitude difference function at a delay time T corresponding to the pitch period obtainable by a linear predictive analysis of the speech signal.

5. A method of judging voiced and unvoiced conditions of a speech signal comprising the steps of determining a ratio $\phi(\tau s)/\phi(o)$ between the value $\phi$(o) of the autocorrelation function of a speech signal at a zero delay time and the value $\phi(\tau s)$ of the autocorrelation function at a delay time $\tau s$ of a sampling period, multiplying said ratio with a constant $a$ to obtain a product, adding said product to the normalized value $\phi(T)/\phi(o)$ of the autocorrelation function at a delay time T corresponding to the pitch period of the speech signal to obtain a sum, and comparing said sum with a predetermined theshold value thereby judging that the speech signal is in an unvoiced condition when said sum is smaller than said threshold value and that the speech signal is in a voiced condition in the other case.

6. A method of judging voiced and unvoiced conditions of a speech signal, comprising the steps of determining a ratio $\phi(\tau s)/\phi$(o) between the value $\phi$(o) of the autocorrelation function of a speech signal at a zero delay time of a speech signal, and the value $\phi(\tau s)$ of the autocorrelation coefficient at a delay time $\tau s$ of a sampling period, multiplying said ratio with the normalized value of the autocorrelation function at a delay time T corresponding to the pitch period of the speech signal to obtain a product, and comparing the product with a predetermined threshold value thereby judging that the speech signal is in an unvoiced condition when said product is smaller than said threshold value and that the speech signal is in a voiced condition in the other case.

7. A method of judging voiced and unvoiced condition of a speech signal, comprising the steps of determining a ratio $\phi(\tau s)/\phi(o)$ between the value $\phi$(o) of the autocorrelation function of a speech waveform at a zero delay time, and the value $\phi(\tau s)$ of the autocorrelation function at a delay time $\tau s$ of a sampling period, multiplying said ratio with a constant $b$ to obtain a product, adding said product to the normalized value $W(T)/W(o)$ of the autocorrelation function at a delay time T corresponding to the pitch period of the residual signal obtainable by a linear predictive analysis of the speech signal to obtain a sum, and comparing said sum with a predetermined threshold value thereby judging that the speech signal is in an unvoiced condition and that the speech signal is in a voiced condition in the other case.

8. A method of judging voiced and unvoiced conditions of a speech signal comprising the steps of determining a ratio $\phi(\tau s)/\phi$(o) between the value $\phi(o)$ of the autocorrelation function of a speech signal at a zero delay time, and the value $\phi(\tau s)$ of the autocorrelation function of a sampling period, at a delay time $\tau s$, multiplying said ratio with the normalized value $W(T)/W(o)$ at a delay time T corresponding to the pitch period of the autocorrelation function of the residual signal obtainable by the linear predictive analysis of the speech signal to obtain a product, and comparing said product with a predetermined threshold value thereby judging that the speech signal is in an unvoiced condition when said product is smaller than said threshold value and that the speech signal is in a voiced condition in the other case.

9. A method of judging voiced and unvoiced conditions of a speech signal, comprising the steps of determining a ratio $\phi(\tau s)/\phi$(o) between the value $\phi$(o) of the autocorrelation function of a speech signal at a zero delay time, and the value $\phi(\tau s)$ of the autocorrelation function of a sampling period at a delay time $\tau s$, multiplying said ratio with a constant $a$ to obtain a product, subtracting the value DT at a delay time T corresponding to the pitch period of the average magnitude difference function of the residual signal obtainable by the linear predictive analysis of the speech signal thus obtaining a difference, and comparing said difference with a predetermined threshold value thereby judging that the speech signal is in an unvoiced condition when said difference is larger than said threshold value and that the speech signal is in a voiced condition in the other case.

10. Apparatus for judging voiced and unvoiced conditions of a speech signal, comprising means for deriving a signal representative of a ratio $k_1 = \phi(\tau s)/\phi$(o) between the value $\phi$(o) of the autocorrelation function of the speech signal at a zero delay time, and the value $\phi(\tau s)$ of the autocorrelation function of the speech signal at a delay time $\tau s$ of a sampling period, means for deriving a signal representative of a parameter $\rho_m$ extracted from the speech signal by correlation technique and representing the degree of the periodicity of the speech signal, means for combining said $k_1$ ratio signal with said $\rho_m$ signal to derive a resultant signal and means for comparing the resultant signal to a threshold signal t determined by the maximum value of the autocorrelation coefficient of the parameter $\rho_m$ when the ratio $k_1$ is equal to zero to judge whether the speech signal is in a voiced condition or an unvoiced conditon.

11. Apparatus for judging voiced and unvoiced conditions of a speech signal comprising means for deriving a signal representative of a ratio $k_1 = \phi(\tau s)/\phi(o)$ between the value $\phi(o)$ of the autocorrelation function of the speech signal at a zero delay time and the value $\phi(\tau s)$ of the autocorrelation function of the speech signal at a delay time $\tau s$ of a sampling period, means for multiplying said $k_1$ signal with a constant $a$ to obtain a product, means for adding said product to a signal $\rho_m$ representative of the normalized value $\phi(T)/\phi(o)$ of the autocorrelation function of the speech signal at a delay time T corresponding to the pitch period of the speech signal to obtain a sum signal, and means for comparing said sum signal with a predetermined threshold signal t determined by the maximum value of the autocorrelation coefficient of the speech signal when the ratio $k_1$ is equal to zero to thereby judge whether the speech signal is in an unvoiced condition if said sum is smaller than said threshold value and that the speech signal is in a voiced condition if the said sum is larger than said threshold value.

12. Apparatus for judging voiced and unvoiced conditions of a speech signal, comprising means for deriving a signal representative of a ratio $k_1 = \phi(\tau s)/\phi(o)$ between the value $\phi(o)$ of the autocorrelation function of the speech signal at a zero delay time, and the value $\phi(\tau s)$ of the autocorrelation coefficient of the speech signal at a delay time $\tau s$ of a sampling period, means for multiplying said $k_1$ signal with a signal representative of a normalized value W(T)/W(o) of the autocorrelation function at a delay time T corresponding to the pitch period of the residual signal to obtain a product signal, and means for comparing the product signal with a predetermined threshold signal t determined by the maximum value of the autocorrelation coefficient of the residual signal when the ratio $k_1$ is equal to zero to thereby judge whether the speech signal is in an unvoiced condition if said product signal is smaller than said threshold signal and that the speech signal is in a voiced condition if the product signal is larger than said threshold signal.

13. Apparatus for judging voiced and unvoiced condition of a speech signal, comprising means for deriving a signal $k_1$ representative of a ratio $\phi(\tau s)/\phi(o)$ between the value $\phi(o)$ of the autocorrelation function of a speech signal at a zero delay time, and the value $\phi(\tau s)$ of the autocorrelation function of the speech signal at a delay time $\tau s$ of a sampling period, means for multiplying said ratio signal $k_1$ with a constant $b$ to obtain a product signal, adding said product signal with a signal representative of the normalized value W(T)/W(o) of the autocorrelation function at a delay time T corresponding to the pitch period of a residual signal obtained by a linear predictive analysis of the speech signal to thereby obtain a sum signal, and means for comparing said sum signal with a predetermined threshold value t determined by the maximum value of the autocorrelation coefficient of the residual signal when the ratio value $k_1$ is equal to zero to thereby judge whether the speech signal is in an unvoiced condition or the speech signal is in a voiced condition.

14. Apparatus for judging voiced and unvoiced conditions of a speech signal comprising means for deriving a signal $k$ representative of a ratio $\phi(\tau s)/\phi(o)$ between the value $\phi(o)$ of the autocorrelation function of a speech signal at a zero delay time, and the value $\phi(\tau s)$ of the autocorrelation function of the speech signal at a delay time s of a sampling period, means for multiplying said $k_1$ signal with a signal representative of the normalized value W(T)/W(o) of the autocorrelation function at a delay time T corresponding to the pitch period of a residual signal obtainable by linear predictive analysis of the speech signal to thereby obtain a product signal, means for comparing said product value with a predetermined threshold value $t$ determined by the maximum value of the autocorrelation coefficient of the speech signal under conditions where the ratio value $k_1$ equals zero to thereby judge whether the speech signal in in an unvoiced condition if said product value is smaller than said threshold value and that the speech signal is in a voiced condition if the product signal is larger than said threshold signal.

15. Apparatus for judging voiced and unvoiced conditions of a speech signal, comprising means for deriving a signal $k$ representative of a ratio $\phi(\tau s)/\phi(o)$ between the value $\phi(o)$ of the autocorrelation function of a speech signal at a zero delay time, and the value $\phi(\tau s)$ of the autocorrelation function of the speech signal at a delay time $\tau s$ of a sampling period, means for multiplying said signal $k_1$ with a constant $a$ to obtain a product signal, means for subtracting said product signal from a signal representative of a parameter extracted from the speech signal by correlation technique and representing the degree of periodicity of the speech signal to derive a difference signal D ($\tau$) representative of the average magnitude difference function of a residual signal obtained by the linear predictive analysis of the speech signal, and means for comparing said difference signal with a predetermined threshold value $t$ determined by the maximum value of the autocorrelation coefficient of the speech signal when the ratio $k_1$ is equal to zero to judge whether the speech signal is in an unvoiced condition if said difference signal is larger than said threshold value and that the speech signal is in a voiced condition if said difference signal is smaller than said threshold value.

16. Apparatus for judging voiced and unvoiced conditions of a speech signal comprising partial correlation coefficient analyzer means responsive to an input speech signal to be judged for deriving a ratio signal $k_1 = \phi(\tau s)/\phi(o)$ between the value $\phi(o)$ of the autocorrelation function of the speech signal at zero dealy time and the value $\phi(\tau s)$ of the autocorrelation function at the speech signal at a delay time $\tau s$ of the sampling period, pitch period detector means responsive to the autocorrelation function signal values supplied from said partial correlation coefficient analyzer means for extracting by correlation technique a normalized autocorrelation function value signal $\rho_m$ representing the degree of periodicity of the speech signal, and voiced-/unvoiced detector means responsive to the ratio signal $k_1$ and the normalized correlation function value signal $\rho_m$ for combining said $k_1$ and $\rho_m$ signals and comparing the resultant signal to a threshold signal t determined by the maximum value of the autocorrelation coefficient values of the residual or the speech signals when the ratio signal $k_1 = o$ to thereby judge whether the speech signal is in a voiced or unvoiced condition.

17. Apparatus according to claim 16 wherein the normalized value signal $\rho_m$ is a normalized value of the autocorrelation function value $\phi(T)/\phi(o)$ of the speech signal at a delay time T corresponding to the pitch period of the speech signal.

18. Apparatus according to claim 16 wherein the normalized value signal $\rho_m$ is a normalized value of the autocorrelation function $W_{(T)}/W_{(O)}$ of the residual signal at a delay time T corresponding to the pitch period of the autocorrelation function of the residual signal obtainable by a linear predictive analysis of the speech signal.

19. Apparatus according to claim 16 wherein the normalized autocorrelation function value signal $\rho_m$ is the value of the average magnitude difference function D($\tau$) of the residual signal at a delay time T corresponding to the pitch period obtainable by a linear predictive analysis of the speech signal.

20. Apparatus according to claim 17 wherein the voiced/unvoiced detector means includes multiplier means for multiplying the ratio signal $k_1$ by a constant a representing the slope of a straight line between voiced and unvoiced regions of the speech signal and adder means for adding together the product signal ($a \times k_1$) and the normalized autocorrelation function value signal $\rho_m$ to derive a resultant signal ($a \times k_1$) $- \rho_m$ for comparison to the threshold signal t to thereby judge that the speech signal is in an unvoiced condition when the resultant signal is smaller than said threshold signal and that the speech signal is in a voiced condition when the resultant signal is larger than the threshold signal.

21. Apparatus according to claim 16 wherein the voiced/unvoiced detector means includes multiplier means for multiplying the ratio signal $k_1$ times the normalized autocorrelation function value signal $\rho_m$ and means for comparing the product signal to the threshold signal t to thereby judge that the speech signal is in an unvoiced condition when the product signal is smaller than the threshold signal and in a voiced condition when the product signal is in larger than the threshold signal.

22. Apparatus according to claim 18 wherein the voiced/unvoiced detector means includes multiplier means for multiplying said $k_1$ ratio signal with a constant b representing the slope of a straight line between voiced and unvoiced regions of the speech signal to thereby obtain a product signal $(b \times k_1)$ and adder means for adding the product signal $(b \times k_1)$ to the normalized autocorrelation function value signal $\rho_m$ to derive a resultant signal $(b \times k_1) + \rho_m$ for comparison to the threshold signal $t$ to thereby judge that the speech signal is in an unvoiced condition when the resultant signal is less than $t$ and that the speech signal is in a voiced condition when the resultant signal is greater than $t$.

23. Apparatus according to claim 18 wherein the voiced/unvoiced detector means includes multiplier means for multiplying the ratio signal $k_1$ times the normalized autocorrelation function value signal $\rho_m$ and means for comparing the product signal to the threshold signal $t$ to thereby judge the speech signal is in an unvoiced condition when the product signal is smaller than the threshold signal and in a voiced condition when the product signal is in larger than the threshold signal.

24. Apparatus according to claim 1 wherein the voiced/unvoiced detector means includes multiplier means for multiplying said $k_1$ ratio signal by a constant a representing the slope of a straight line be between voiced and unvoiced portions of the speech signal and subtractor means for subtracting the value $D(\tau)$ of the average magnitude difference function of the residual signal to obtain a difference signal, and comparison means for comparing the difference signal to the threshold signal $t$ to thereby judge that the speech signal is in an unvoiced condition when said difference signal is larger than the threshold signal and in a voiced condition when the threshold signal is larger than the difference signal.

* * * * *